US011724500B2

(12) United States Patent
Kusunoki

(10) Patent No.: US 11,724,500 B2
(45) Date of Patent: Aug. 15, 2023

(54) LIQUID EJECTION HEAD

(71) Applicant: TOSHIBA TEC KABUSHIKI KAISHA, Tokyo (JP)

(72) Inventor: Ryutaro Kusunoki, Mishima Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 72 days.

(21) Appl. No.: 17/528,737

(22) Filed: Nov. 17, 2021

(65) Prior Publication Data

US 2022/0227132 A1 Jul. 21, 2022

(30) Foreign Application Priority Data

Jan. 20, 2021 (JP) ..... 2021-007372

(51) Int. Cl.
*B41J 2/14* (2006.01)

(52) U.S. Cl.
CPC ..... *B41J 2/1433* (2013.01); *B41J 2/14209* (2013.01)

(58) Field of Classification Search
CPC ..... B41J 2/1433; B41J 2/14209; B41J 2/0453
See application file for complete search history.

(56) References Cited

U.S. PATENT DOCUMENTS 5,736,993 A * 4/1998 Regimbal ..... B41J 2/04593 347/70
6,106,106 A 8/2000 Nakazawa et al.
8,573,753 B2 11/2013 Shimosato
8,998,381 B2 4/2015 Domae
9,028,025 B2 5/2015 Norigoe
2005/0099452 A1* 5/2005 Kusunoki ..... B41J 2/04581 347/40
2007/0176985 A1* 8/2007 Takeuchi ..... B41J 2/04596 347/85
2010/0118073 A1* 5/2010 Kitami ..... B41J 2/04596 347/10
2013/0050338 A1 2/2013 Shimosato

FOREIGN PATENT DOCUMENTS

JP H0596730 A 4/1993
JP 2000135787 A 5/2000

OTHER PUBLICATIONS

Extended European Search Report dated Jun. 13, 2022, mailed in counterpart European Application No. 21215912.3, 5 pages.

* cited by examiner

*Primary Examiner* — Jason S Uhlenhake
(74) *Attorney, Agent, or Firm* — Kim & Stewart LLP

(57) ABSTRACT

According to an embodiment, a liquid ejection head includes a plurality of drive flow paths, a plurality of dummy flow paths, and a plurality of side walls. The drive flow paths connect to liquid ejection nozzles. The dummy flow paths connect to dummy nozzles. The dummy flow paths are adjacent the drive flow paths. The side walls are between the drive flow paths and the dummy flow paths and configured to change volumes of both the drive flow paths and the dummy flow paths in response to drive signals. An acoustic resonance period of liquid in the dummy flow paths is shorter than an acoustic resonance period of the liquid in the drive flow paths.

20 Claims, 7 Drawing Sheets

LIQUID EJECTION HEAD

CROSS-REFERENCE TO RELATED APPLICATION

This application is based upon and claims the benefit of priority from Japanese Patent Application No. 2021-007372, filed Jan. 20, 2021, the entire contents of which are incorporated herein by reference.

FIELD

Embodiments described herein relate generally to a liquid ejection head.

BACKGROUND

A liquid ejection head, such as an inkjet head or an inkjet printer head, can include a nozzle plate and a base plate. The nozzle plate includes a plurality of nozzles. The base plate is provided facing the nozzle plate and forms or includes a plurality of pressure chambers that are fluidly connected to the nozzles and a common chamber. A voltage can be applied to a drive element provided for the pressure chambers so as to cause a pressure change in the pressure chambers so that liquid is ejected from a nozzle. A liquid tank is connected to the liquid ejection head, and the liquid from the tank circulates in a circulation path that passes through the liquid ejection head back to the liquid tank.

In an inkjet printer head of shear-mode shared wall type, dummy chambers which are not utilized to eject ink may be provided alternately with actual (non-dummy) pressure chambers that are used to eject ink. The nozzles are fluidly connected a non-dummy pressure chamber, but the dummy chambers are not connected to any nozzle. Any nozzle adjacent to a dummy chamber is blocked off from the dummy chamber by the nozzle plate or the like.

DETAILED DESCRIPTION

At least one embodiment of the present disclosure provides a liquid ejection head having lower crosstalk between adjacent pressure chambers.

According to an embodiment, a liquid ejection head includes a plurality of drive flow paths, a plurality of dummy flow paths, and a plurality of side walls. The drive flow paths connect to liquid ejection nozzles. The dummy flow paths connect to dummy nozzles. The dummy flow paths are adjacent the drive flow paths. The side walls are between the drive flow paths and the dummy flow paths and configured to simultaneously change volumes of both the drive flow paths and the dummy flow paths in response to a drive signal. A first acoustic resonance period of liquid in the dummy flow paths is shorter than a second acoustic resonance period of the liquid in the drive flow paths.

First Embodiment

Figure 1:
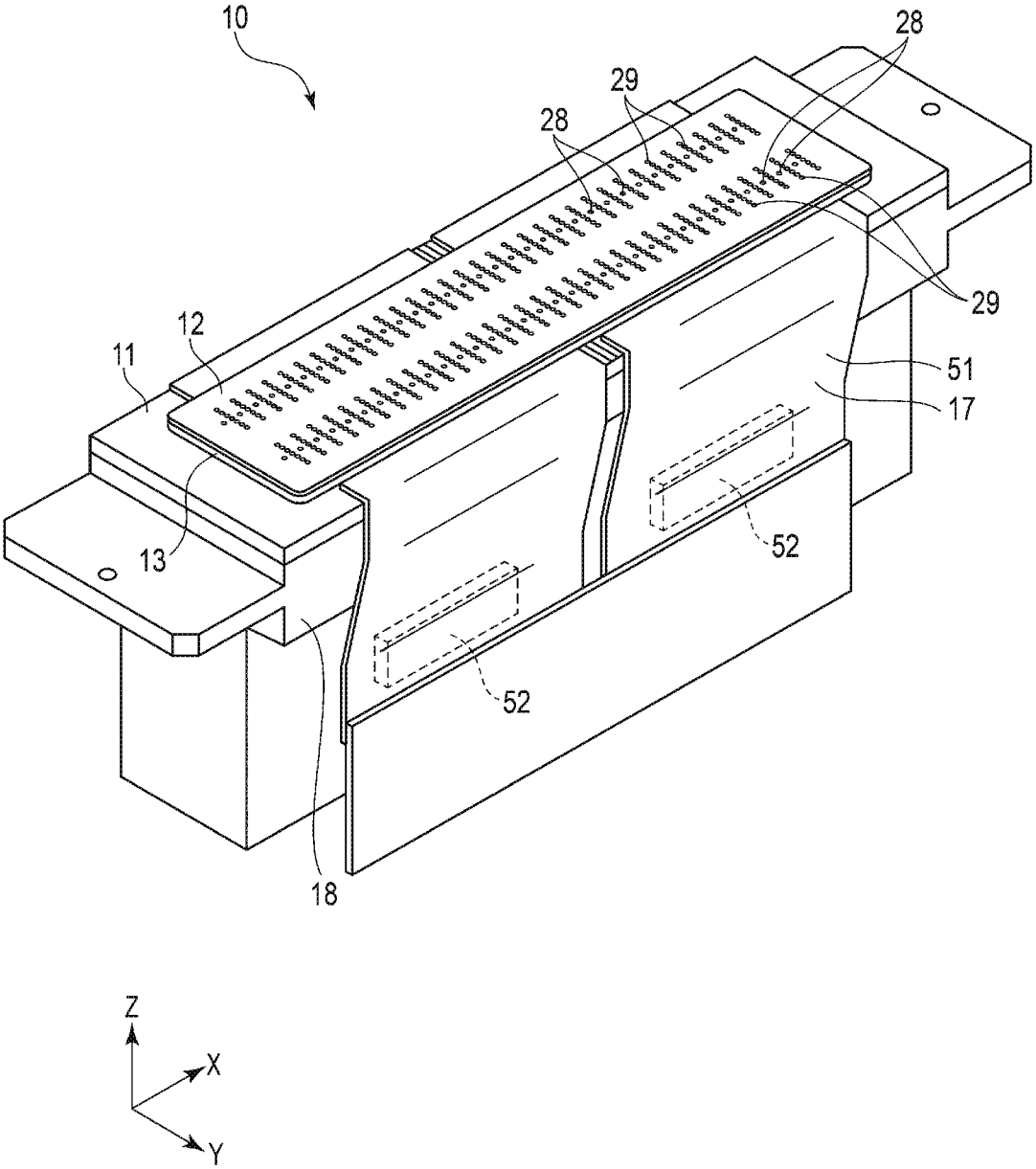
FIG. 1 depicts an inkjet head in a perspective view according to a first embodiment.
Figure 2:
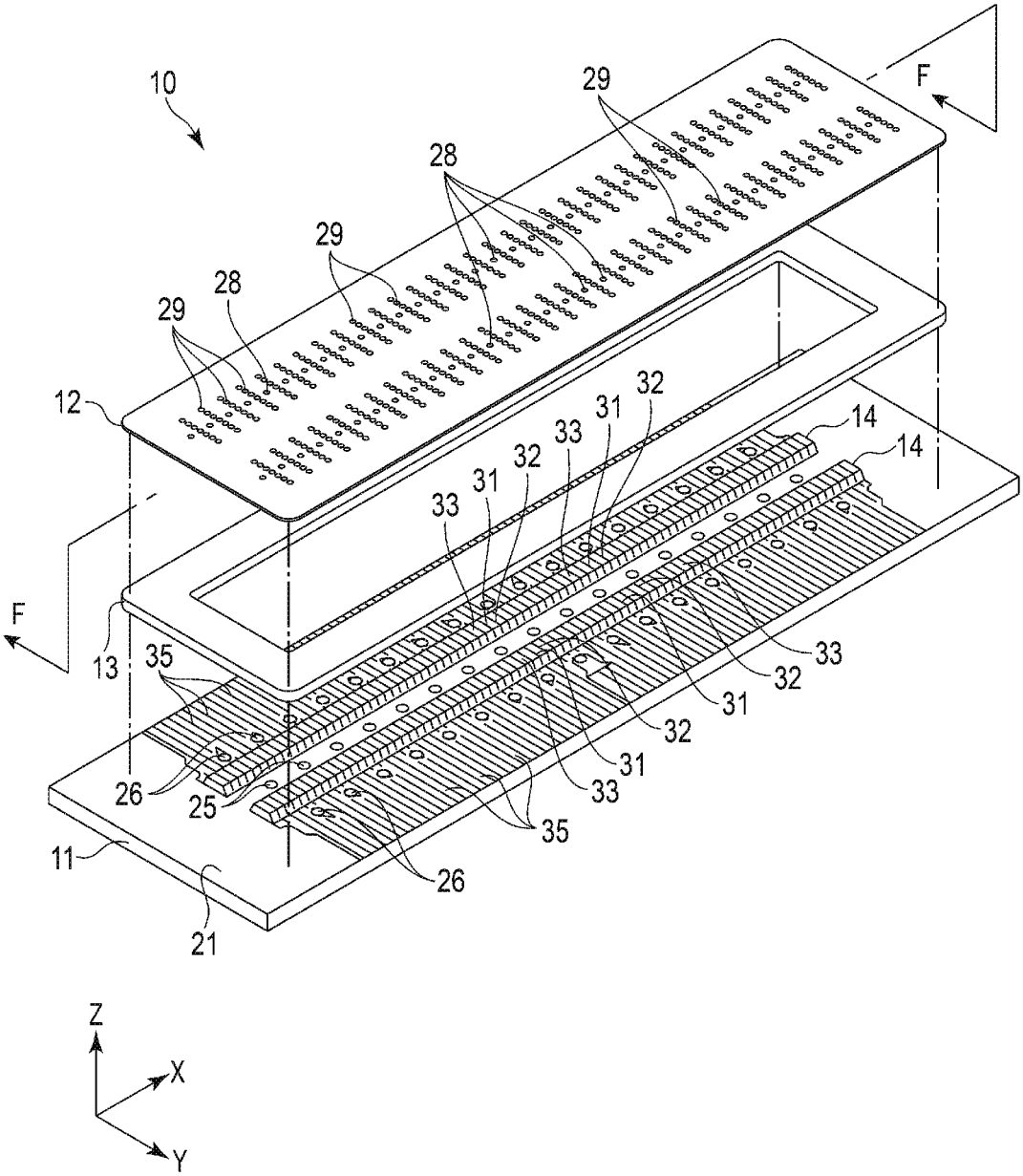
FIG. 2 depicts aspects of an inkjet head in an exploded perspective view.
Figure 3:
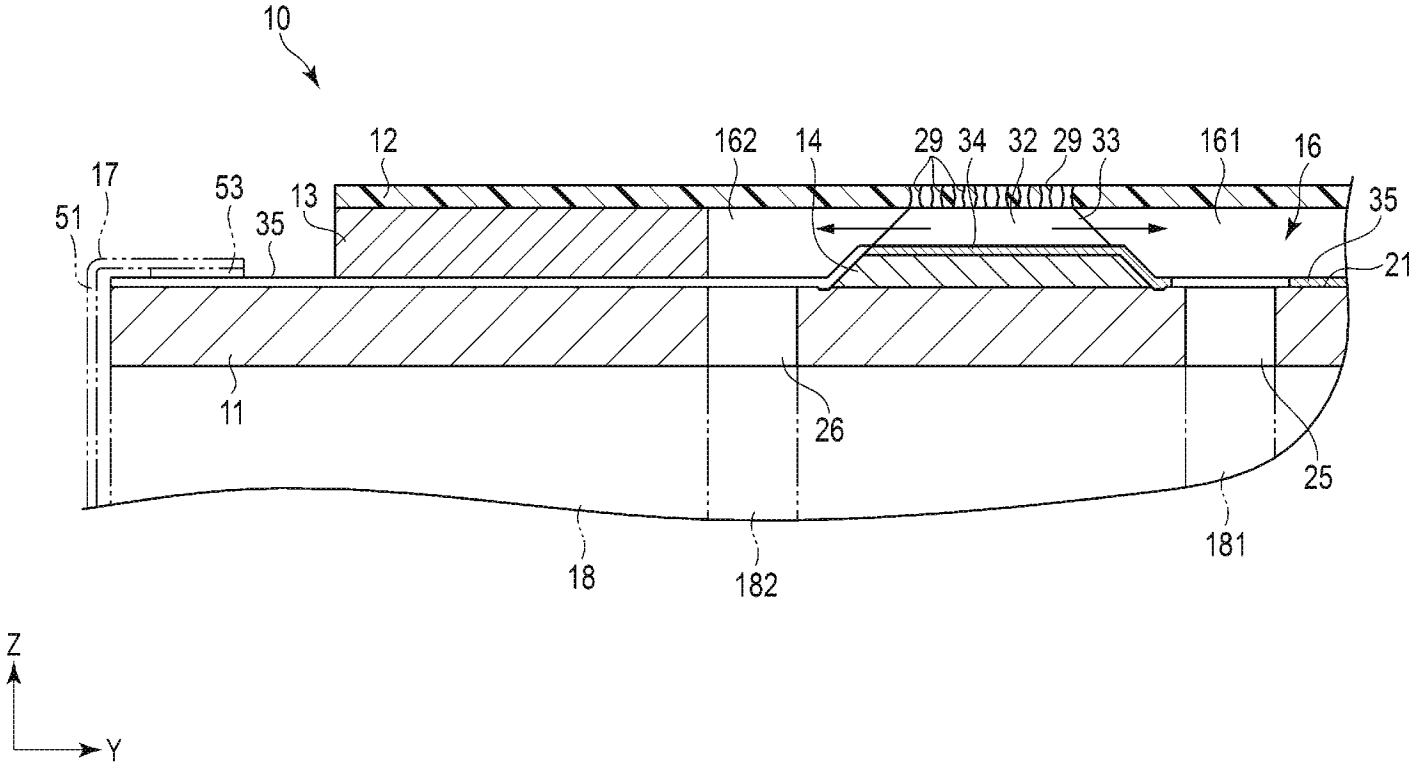
FIG. 3 depicts aspects of an inkjet head in a cross-sectional view according to a first embodiment.
Figure 4:
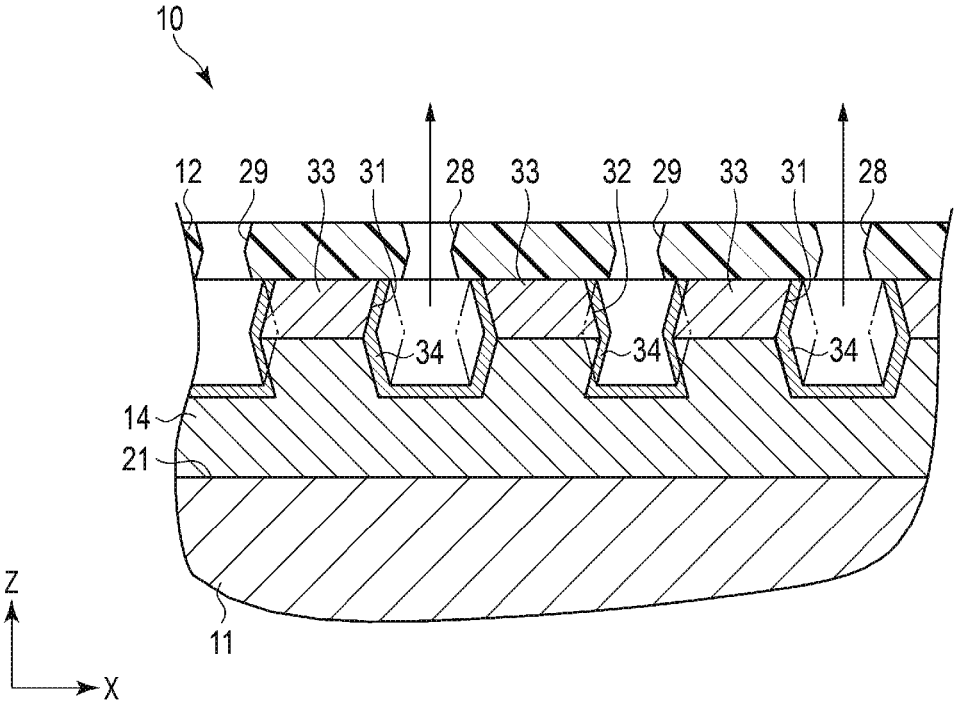
FIG. 4 depicts aspects of an inkjet head in a cross-sectional view according to a first embodiment.
Figure 5:
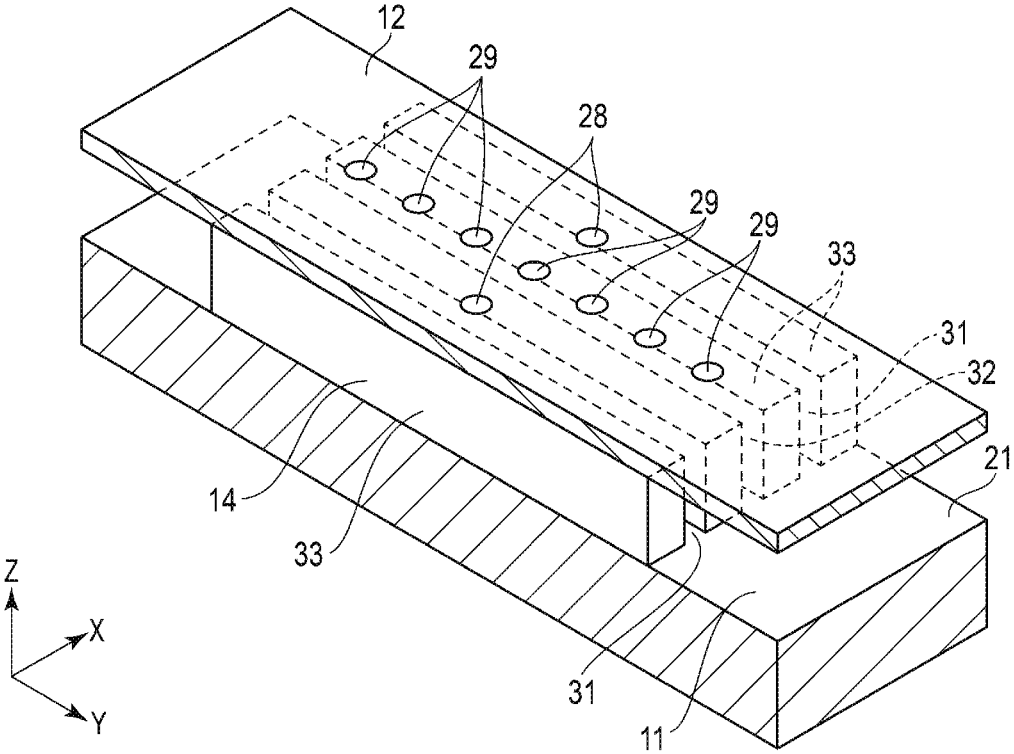
FIG. 5 depicts aspects of an inkjet head in an enlarged perspective view according to a first embodiment.

A configuration of an inkjet head 10 that is one example of a liquid ejection head according to a first embodiment will be described with reference to FIGS. 1 to 5. FIG. 1 is a perspective view illustrating an inkjet head of the first embodiment. FIG. 2 is an exploded perspective view illustrating a portion of the inkjet head. FIGS. 3 and 4 are cross-sectional views, and FIG. 5 is a perspective view illustrating a portion of the inkjet head in an enlarged manner. In the example embodiments, the parallel arrangement direction for ejection nozzles 28 and for drive flow paths 31 of the inkjet head 10 is along or parallel to the X axis, which may be referred to as along or in the X direction, the extension direction of each of the drive flow paths 31 is along or parallel to the Y axis, which may be referred to as along or in the Y direction, and the ejection direction for liquid from the ejection nozzles 28 is along or parallel to the Z axis, which may be referred to as along or in the Z direction. In general, unless otherwise stated, references to these directions are intended to be descriptive of the relative orientation and/or positions amongst the described device elements themselves rather than to any other fixed or absolute coordinate system (such as the direction of gravity or the like).

As illustrated in FIG. 1, the inkjet head 10 is of a shear-mode shared wall type having a so-called side shooter design. The inkjet head 10 is configured to eject ink and is provided, for example, in an inkjet printer.

The inkjet head 10 includes a base plate 11, a nozzle plate 12, and a frame member 13. The base plate 11 is one example of a base or a base member. An ink chamber 16 (see FIG. 3) is formed inside the inkjet head 10. The ink chamber 16 holds ink that can be supplied from an ink tank or the like. The ink is one example of a liquid to be ejected from the inkjet head 10.

Other components, such as a circuit board 17 and a manifold 18, are attached to the inkjet head 10. The circuit board 17 controls the inkjet head 10. The manifold 18 forms a portion of an ink circulation path between the inkjet head 10 and the ink tank.

The base plate 11 has, for example, a rectangular plate shape formed using ceramics, such as alumina. The base plate 11 includes a flat installation surface 21 (also referred to as mounting surface 21). As shown in FIG. 2, a plurality of supply holes 25, a pair of actuators 14, a plurality of discharge holes 26 are provided on the installation surface 21.

The supply holes 25 are provided next to each other in a row along the longitudinal direction (a first direction/X direction) of the base plate 11. The row of the supply holes 25 is positioned at a central portion or on a center line of the base plate 11 with respect to the width direction (a second direction/Y direction) of the base plate 11. As shown in FIG. 3, each supply hole 25 communicates with an ink supply unit 181 of the manifold 18. Each supply hole 25 is connected to the ink tank via the ink supply unit 181. The ink of the ink tank is supplied to the ink chamber 16 from the respective supply holes 25.

As illustrated in FIG. 2, the discharge holes 26 are provided side by side in two rows parallel to the row of the supply holes 25, with the row of supply holes being therebetween. Each discharge hole 26 communicates with an ink discharge unit 182 of the manifold 18 (see FIG. 3). Each discharge hole 26 is connected to the ink tank via the ink discharge unit 182. The ink of the ink chamber 16 is discharged from the respective discharge holes 26 to the ink tank. In this manner, the ink circulates between the ink tank and the ink chamber 16.

The pair of actuators 14 are adhered to the installation surface 21 of the base plate 11. The actuators 14 are in two rows parallel to the row of the supply holes 25 with one of the actuators 14 on each side of the row of supply holes. Each actuator 14 comprises, for example, two plate-shaped piezoelectric bodies formed of lead zirconate titanate (PZT). The two piezoelectric bodies are bonded together so that the polarization directions are opposite to each other in its thickness direction. Each actuator 14 is adhered to the installation surface 21 with, for example, a thermosetting epoxy-based adhesive. The two rows of the actuators 14 are disposed corresponding to, respectively, two rows of ejection nozzles 28 provided in the longitudinal direction of the nozzle plate 12 (see FIG. 2). The two rows of the actuators 14 are also positioned in parallel inside the ink chamber 16. As illustrated in FIG. 3, the actuators 14 divide the ink chamber into at least one supply chamber 161 and two discharge chambers 162. The supply chamber 161 are formed between the two rows of the actuators 14, and the supply holes 25 of the base plate 11 communicate with the supply chamber 161 through the installation surface 21. The two discharge chambers 162 are formed on the other side of the actuators 14 from the supply chamber 161 in the width direction (Y direction in FIG. 3), and the discharge holes 26 of the base plate 11 communicate with the discharge chambers 162 through the installation surface 21.

Each actuator 14 is formed into a trapezoidal cross section shape. The top of the actuator 14 adheres to the nozzle plate 12. The actuator 14 includes a plurality of drive flow paths 31 and a plurality of dummy flow paths 32. The drive flow paths 31 and the dummy flow paths 32 are pressure chambers formed by grooves, which have the same shape with each other, at the top of the actuator 14, and side walls 33 are formed between the grooves as drive elements. The shape of each drive flow path 31 may be different from that of each dummy flow path 32. As shown in FIGS. 3 and 4, at least one side wall 33 is formed between the neighboring drive flow path 31 and dummy flow path 32, and configured to simultaneously change the volumes of both the drive flow path 31 and the dummy flow path 32 in response to one or more drive signals.

As shown in FIGS. 4 and 5, the drive flow paths 31 and the dummy flow paths 32 are alternately disposed and separated from each other by the side walls 33. The drive flow paths 31 and the dummy flow paths 32 each extend in the direction (a second direction/Y direction) intersecting the longitudinal direction (a first direction/X direction) of the actuators 14 and are in parallel with each other in the longitudinal direction (a first direction/X direction) of the actuators 14.

The plurality of ejection nozzles 28 of the nozzle plate 12 are open in the plurality of drive flow paths 31. One end portion of the drive flow path 31 is open to the supply chamber 161 of the ink chamber 16. The other end portion of the drive flow path 31 is open to the discharge chamber 162 of the ink chamber 16. That is, both ends of the drive flow paths 31 are open to the ink chamber 16. Therefore, the ink flows in from one end portion of the drive flow path 31 and then out from the other end portion.

The nozzle plate 12 also includes a plurality of dummy nozzles 29 open to the dummy flow paths 32. One end of the dummy flow path 32 is open to the supply chamber 161. The other end of the dummy flow path 32 is open to discharge chambers 162. That is, both ends of the dummy flow paths 32 connect to the ink chamber 16. Therefore, the ink flows in from the one end of the dummy flow path 32 and out from the other end.

Electrodes 34 are provided for each of the drive flow paths 31 and the dummy flow paths 32. The electrodes 34 are formed by, for example, a nickel thin film. The electrodes 34 cover inner surfaces of the drive flow paths 31 and the dummy flow paths 32.

The ink chamber 16 is formed by the surrounding base plate 11, nozzle plate 12, and frame member 13. The ink chamber 16 is a region formed between the base plate 11 and the nozzle plate 12.

As illustrated in FIG. 2, pattern wirings 35 are formed on the installation surface 21 of the base plate 11. The pattern wirings 35 are, for example, formed from a nickel thin film. Each pattern wiring 35 has a common pattern portion and an individual pattern portion, and reaches a particular one of the electrodes 34 of an actuator 14.

The nozzle plate 12 is, for example, a rectangular film made of polyimide. The nozzle plate 12 faces the installation surface 21 of the base plate 11. The nozzle plate 12 has the ejection nozzles 28 and the dummy nozzles 29 penetrating therethrough in the thickness direction.

The plurality of ejection nozzles 28 are provided in the same number as the drive flow paths 31 in the longitudinal direction (first direction/X direction) of the nozzle plate 12, and each of the ejection nozzles 28 connects with a corresponding one of the drive flow paths 31. The ejection nozzles 28 are arranged in two rows parallel to each other in the width direction (second direction/Y direction) of the nozzle plate 21. Each of the rows corresponds to one of the pair of actuators 14. Each ejection nozzle 28 has a generally cylindrical shape. In some examples, the ejection nozzle 28 may have a constant diameter or a changing diameter that decreases at some point along the length of the generally cylindrical shape, such as at the central portion or towards an end of the cylindrical shape. If some portion of the ejection nozzle 28 is reduced in diameter, the diameter of the smallest portion is regarded as the diameter of the ejection nozzle 28. The ejection nozzles 28 overlap the drive flow paths 31 formed by the pair of actuators 14 and fluidly connect to one of the drive flow path 31. Each of the ejection nozzles 28 is positioned near the central portion of one of the drive flow paths 31.

As illustrated in FIG. 2, dummy nozzles 29 are also arranged in two rows spaced from each other in the width direction (Y direction). The two rows of dummy nozzles 29 correspond in general to the pair of actuators 14 and thus run in the longitudinal direction (X direction) like the two rows of the ejection nozzles 28. These two rows each include subgroups (or subsets) of the dummy nozzles 29. Each subgroup includes multiple dummy nozzles 29 aligned with each other along the width direction (Y direction) of the nozzle plate 12. Each of these subgroups of each row of the dummy nozzles 29 is aligned to a subgroup in the opposite row. Each dummy nozzle 29 in the same subgroup of dummy nozzles 29 faces the same one of the dummy flow paths 32 (see also FIG. 5).

The summed total opening area of the dummy nozzles 29 on each dummy flow path 32 can be set such that ink will not be ejected from the dummy flow path 32 and the acoustic resonance period of ink inside the dummy flow path 32 will be shorter than an acoustic resonance period of ink inside a drive flow path 31. For example, the total nozzle opening area of the dummy nozzles 29 is set to be greater than that of the nozzle opening area of the single ejection nozzle 28 on a drive flow path 31. In one instance, the acoustic resonance period of the dummy flow path 32 may be set to be equal to or shorter than one-half (½) of the acoustic resonance period of the drive flow path 31. In another instance, the acoustic resonance period of the dummy flow path 32 may be one-half (½) of the acoustic resonance period of the drive flow path 31. As one example, a half cycle (AL) of the acoustic resonance period of the drive flow path 31 may be set to satisfy the following relationship:

$$AL=2\pi/\{c\sqrt{(Sn/Vd/Ln)}\}.$$

In this context, the value c is the pressure propagation velocity of the ink in the dummy flow path 32, the value Sn is the opening area of a dummy nozzle 29 on the dummy flow path 32, the value Ln is the length of an ejection nozzle 28 and a dummy nozzle 29 and the length Ln is equal to the thickness of the nozzle plate 12, and the value Vd is a volume of the dummy flow path 32 for each dummy nozzle 29 (dummy flow path volume per dummy nozzle on the dummy flow path).

In the present embodiment, each of the dummy nozzles 29 has the same or substantially the same shape as each of the ejection nozzles 28. Each subgroup of the dummy nozzles 29 in each of the two rows extends over the entire length or substantially the entire length of the corresponding one of the dummy flow paths 32 in the width direction (second direction/Y direction) of the nozzle plate 12 or the base plate 11, that is the lengthwise direction of the dummy flow path 32 (see FIG. 5). In this case, for example, dummy nozzles 29 at both ends of the dummy nozzle subgroup are positioned at or near the lengthwise ends of the corresponding dummy flow path 32.

Each dummy nozzle 29 may have a diameter that is constant or that changes in the thickness direction (third direction/Z direction) of the nozzle plate 12. In the latter case, for example, the diameter of the dummy nozzle 29 may decreases at a nozzle central portion in the ink ejecting direction or gradually decreases, towards an end of the nozzle. In general, the narrowest (smallest) diameter along the length of the dummy nozzle 29 is taken as a diameter of the dummy nozzle 29.

In one example where:

the thickness Ln of the nozzle plate 12=50 μm;

the diameter of the ejection nozzle 28=Φ 20 μm;

the diameter of the dummy nozzle 29=Φ 20 μm;

the number of dummy nozzles 29 arranged in one dummy flow path 32=20;

the size of the drive flow path 31=(40 μm×150 μm×2 mm); and the size of the dummy flow path 32=(40 μm×150 μm×2 mm);

ink density $\rho=1000\ kg/m^3$;

pressure propagation velocity c of ink in the flow paths 31 and 32=920 m/s;

groove width Wc=40 μm;

groove depth Hc=150 μm;

flow path length Lc=2 mm;

diameter Dn of each dummy nozzle 29=20 μm;

nozzle length Ln=50 μm;

dummy nozzle interval Ld=0.1 mm (20 dummy nozzles); and nozzle cross-sectional area $Sn=\pi Dn^2/4$, the volume Vd of the dummy flow path 32 per dummy nozzle 29 satisfies the following relationship:

$$Vd=Wc\cdot Hc\cdot Ld.$$

Therefore, the acoustic resonance period T of the dummy flow path 32 is equal to $2\pi/\{c\sqrt{(Sn/Vd/Ln)}\}$, and T will be 2.11 μs (Helmholtz resonance frequency).

The acoustic resonance period of the drive flow path 31 is:

$$2Lc/c=4.35\ \mu s.$$

Hence, the acoustic resonance period of the dummy flow path 32 will be equal to or less than one-half (½) of the acoustic resonance period of the drive flow path 31.

Referring back to FIGS. 1 and 2, the frame member 13 has a rectangular frame shape formed using, for example, a nickel alloy. The frame member 13 is interposed between the installation surface 21 of the base plate 11 and the nozzle plate 12. The frame member 13 adheres to the installation surface 21 and the nozzle plate 12. The nozzle plate 12 is attached to the base plate 11 via the frame member 13.

The manifold 18 is joined to the base plate 11 on the opposite side from the nozzle plate 12. The ink supply unit 181 constitutes part of a flow path connecting to the supply hole 25, and the ink discharge unit 182 constitutes part of a flow path connecting to the discharge hole 26. The ink supply unit 181 and the ink discharge unit are formed inside the manifold 18 (see FIG. 3).

The circuit board 17 is a film carrier package (FCP) and includes a film 51 and one or more ICs 52. The film 51 is a resin on which a plurality of wirings are formed. The film 51 has flexibility. The ICs 52 are connected to the wirings on the film 51. The FCP is also referred to as a tape carrier package (TCP). The film 51 is tape automated bonding (TAB), for example. One end portion of the film 51 is connected to the pattern wirings 35 on the installation surface 21 by thermocompression using an anisotropic conductive film (ACF) 53. The ICs 52 apply voltages to the electrodes 34. The ICs 52 are fixed to the film 51 by, for example, a resin. The ICs 52 are electrically connected to the electrodes 34 via the wirings of the film 51 or the pattern wirings 35 of the base plate 11.

In the inkjet head 10 according to the present embodiment, the ICs 52 apply drive voltages to the electrodes 34 of the drive flow paths 31 via the wirings of the film 51 by a signal from a control unit of an inkjet printer in which the inkjet head 10 is installed. The application of the drive voltages causes a difference in potential between the electrode 34 of each of the drive flow paths 31 and the electrode 34 of each of the dummy flow 32 so that a side wall 33 is selectively deformed in shear mode. The side wall 33 between a drive flow path 31 and a dummy flow path 32 deforms in response to the drive signals so that the volumes of the drive flow path 31 and the dummy flow path 32 are both simultaneously changed.

By deforming the side wall 33 in shear mode, the volume of the drive flow path 31 provided with the corresponding electrode 34 increases, and the pressure decreases. This causes the ink in the ink chamber 16 to flow into the corresponding drive flow path 31. Simultaneously, the volume of the dummy flow path 32 adjacent the corresponding drive flow path 31 decreases, and the pressure increases.

This increase in the pressure of the dummy flow path 32 pushes the ink of the dummy flow path 32 out from both ends of the dummy flow path 32 to the ink chamber 16, and the pressure change in the dummy flow path 32 is reduced.

When the volume of the drive flow path 31 is to be increased, the IC 52 applies a drive voltage of a reverse potential to the electrode 34 of the drive flow path 31. As a result, the side wall 33 deforms, the volume of the drive flow path 31 provided with the corresponding electrodes 34 decreases, and the pressure increases. This pressurizes the ink in the drive flow path 31, and the ink can be ejected from the nozzle 28.

With the liquid ejection head, such as the inkjet head 10, according to the present embodiment, crosstalk between adjacent nozzles can be suppressed. In the inkjet head 10, the dummy flow paths 32 includes the dummy nozzles 29 and is formed between the two neighboring drive flow paths 31 that form the pressure chambers communicating with the ejection nozzles 28, and the acoustic resonance periods of the drive flow path 31 and the dummy flow path 32 are set to be different from each other by inclusion of the dummy nozzles 29. This mitigates or suppresses the crosstalk between the adjacent ejection nozzles 28.

For example, when ink is to be simultaneously ejected from three adjacent ejection nozzles 28 having dummy flow paths 32 sandwiched therebetween, at the time of ejection of the ink from the middle nozzle of the three nozzles 28, the corresponding side walls 31 acting as a drive element can be selectively deformed to pressurize the middle drive flow path 31, the pressures in the adjacent dummy flow paths 32 will be correspondingly reduced, and the thus the deformation amounts that will be caused the adjacent drive elements can decrease. Therefore, the pressurization amount for the adjacent drive flow paths is reduced.

Figure 6:
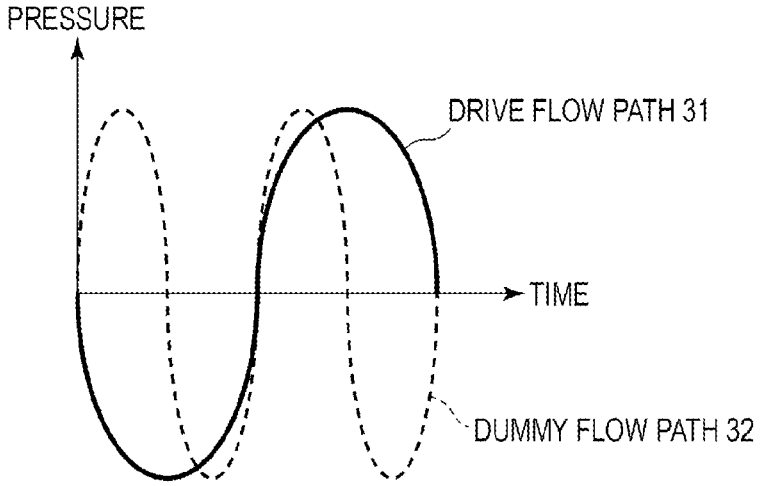
FIG. 6 is a graph illustrating an example of an acoustic resonance period of a drive flow path and a dummy flow path in an inkjet head according to a first embodiment.

When there are no dummy nozzles 29 on the dummy flow path 32, if the multiple adjacent ejection nozzles 28 are to be simultaneously driven, speed and volume of an ink droplet from adjacent ejection nozzles 28 can be reduced and printing quality may be deteriorated as compared with the case in which only a single ejection nozzle 28 at a time is driven to eject the ink. In such a case, liquid ejection performance cannot be maintained at an expected or a desired level. On the other hand, in the present embodiment, as shown in FIG. 6, if the acoustic resonance period of the dummy flow path 32, with which the dummy nozzles 29 communicate, is set to one-half (½) of the acoustic resonance period of the drive flow path 31, the influence of the pressure variation in the dummy flow paths 32 will be offsetting with respect to each other during the period of the half cycle of the pressure vibration of the drive flow path 31. Accordingly, the influence of pressure vibrations of the dummy flow paths 32 will be reduced. Therefore, the crosstalk between the adjacent ejection nozzles 28 will be mitigated or suppressed, and the liquid ejection performance can be maintained at a desired level and/or a greater liquid ejection performance can be achieved.

In the inkjet head 10, the drive flow paths 31 and the dummy flow paths 32 are alternately disposed, and ink can be simultaneously ejected from each of the drive flow paths 31. Thus, the drive frequency of the inkjet head 10 can be further increased. Since both ends of each of the dummy flow paths 32 are open to the ink chamber 16, each dummy flow path 32 can be easily filled with the ink, and accumulation of air in the dummy flow path 32 can be suppressed. Further, since the ink of each dummy flow path 32 flows from the supply chamber 161 of the ink chamber 16 to the discharge chamber 162, increase in liquid temperature of the ink in the dummy flow path 32 can be suppressed. Accordingly, even if the inkjet head 10 has the dummy flow path 32 provided in addition to the drive flow path 31, the influence on the ink ejection due to a different crosstalk amount of the drive flow path 31 or the increase in the temperature of the ink of the dummy flow path 32 can be effectively suppressed.

Second Embodiment

Figure 7:
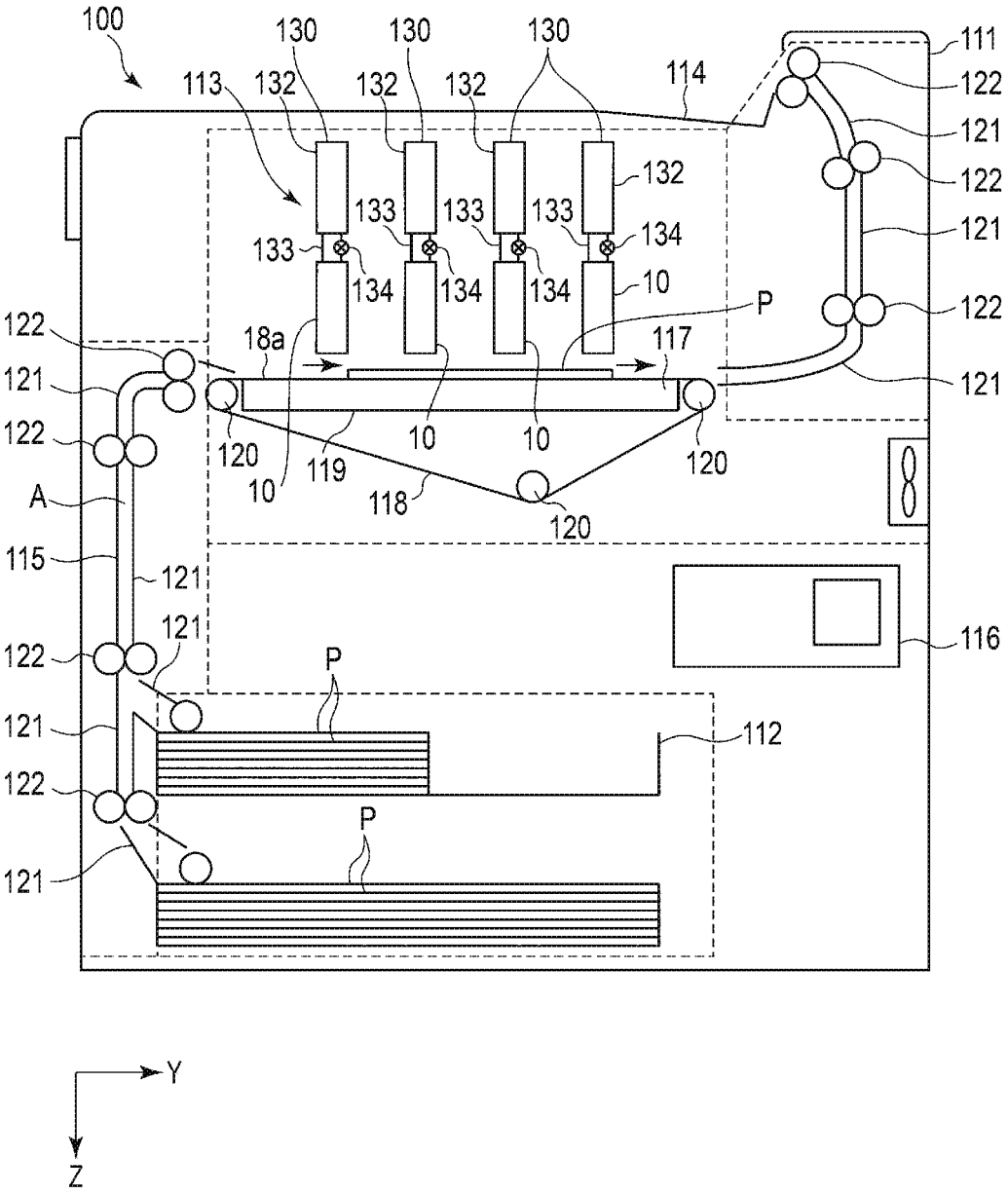
FIG. 7 depicts a configuration example of an inkjet recording device according to a second embodiment.

An example of an inkjet recording device 100 including the inkjet head 10 will be described as a second embodiment with reference to FIG. 7. The inkjet recording device 100 includes a housing 111, a medium supply unit 112, an image forming unit 113, a medium discharge unit 114, a conveyance device 115, and a control unit 116.

The inkjet recording device 100 is one example of a liquid ejection device. The inkjet recording device 100 performs an image forming process on a sheet of paper P that serves as a recording medium. The inkjet recording device 100 ejects liquid (e.g., ink) on to an ejection target (e.g., a sheet of paper). By ejecting a liquid while conveying the ejection target along a predetermined conveyance path A from the medium supply unit 112 to the medium discharge unit 114 via the image forming unit 113 and image can be formed on the ejection target (paper P).

The housing 111 includes an outer frame of the inkjet recording device 100. A discharge port for discharging the sheet P to the outside is provided in the housing 111.

The medium supply unit 112 includes a plurality of paper feed cassettes and is configured to hold a plurality of sheets P of various sizes.

The medium discharge unit 114 includes a sheet discharge tray configured to hold the sheet P after discharge from the discharge port.

The image forming unit 113 includes a supporting unit 117 that supports the sheet P and a plurality of head units 130 that face the supporting unit 117 at a position above the supporting unit 117.

The supporting unit 117 includes a conveyance belt 118 provided in a loop shape, a support plate 119 that supports the conveyance belt 118 from the back side, and a plurality of belt rollers 120 provided on the back side of the conveyance belt 118.

At the time of forming an image, the supporting unit 117 supports the sheet P on its sheet holding surface that is an upper surface of the conveyance belt 118 and conveys the sheet P downstream by rotating the belt rollers 120 and sending forward the conveyance belt 118 at a predetermined timing.

The head units 130 are for ejecting different colors, such as four colors, respectively. Each head unit 130 includes an inkjet head 10 for one corresponding color (there are four inkjet heads 10 for four colors in the example shown in FIG. 7), an ink tank 132 as a liquid tank of the corresponding color mounted on the inkjet head 10, a connection flow path 133 that connect the inkjet head 10 to the ink tank 132, and a circulation pump 134 that is one example of a circulation unit. Each head unit 130 is a circulation-type head unit that constantly circulates the liquid or the ink in the ink tank 132 as well as in the drive flow paths 31, the dummy flow paths 32 and the ink chamber 16 which are provided inside the inkjet head 10.

In the present example, the inkjet heads 10 are for four colors (cyan, magenta, yellow, and black), and ink tanks 132 for respectively containing inks of these four colors are provided. Each ink tank 132 is connected to the corresponding inkjet head 10 by a connection flow path 133. The connection flow path 133 includes a supply flow path connected to a liquid supply port of the inkjet head 10 and a collection flow path that is connected to a liquid discharge port of the inkjet head 10.

A negative pressure control device, such as a pump, is also connected to the ink tank 132. The negative pressure control device controls pressure inside the ink tank 132 according to head pressure values of both the inkjet head 10 and the ink tank 132 to form a meniscus of ink within each ejection nozzle 28.

The circulation pump 134 is, for example, a liquid feed pump comprising a piezoelectric pump. The circulation pump 134 is provided on the supply flow path of the connection flow path 133. The circulation pump 134 is connected to a drive circuit of the control unit 116 by wiring and is controlled by a Central Processing Unit (CPU). The circulation pump 134 circulates the liquid in a circulation flow path including the inkjet head 10 and the ink tank 132.

The conveyance device 115 conveys the sheet P along the conveyance path A from the medium supply unit 112 to the medium discharge unit 114 via the image forming unit 113. The conveyance device 115 includes a plurality of guide plate pairs 121 disposed along the conveyance path A and a plurality of conveyance rollers 122.

Each of the guide plate pairs 121 includes a pair of plate members arranged to face each other sandwiching the sheet P therebetween and is configured to guide the sheet P along the conveyance path A.

The conveyance rollers 122 are driven and rotate by the control of the control unit 116 to send the sheet P downstream along the conveyance path A. On the conveyance path A, sensors for detecting a conveyance circumstance or condition of the sheet P are provided in various appropriate places or at predetermined positions within the inkjet recording device 100.

The control unit 116 includes a control circuit as a controller, such as a CPU, a Read Only Memory (ROM) that stores various programs, a Random Access Memory (RAM) that temporarily stores various variable data and image data, and an interface unit that receives data from outside of the inkjet recording device 100, such as a separate unit, an external device and a network, and outputs data to the outside.

In the inkjet recording device 100, upon detection of a print instruction from a user who operates an operation input unit of an operation interface provided to the inkjet recording device 100, the control unit 116 drives the conveyance device 115 to convey the sheet P along the conveyance path A and outputs one or more print signals to the head units 130 at a predetermined timing to drive the inkjet heads 10.

As part of liquid ejection operation, the inkjet heads 10 send one or more drive signals to the ICs 52 by one or more image signals in response to the image data temporarily stored in the RAM, apply the drive voltages to the electrodes 34 of the drive flow paths 31 via the wirings, selectively drive the side walls 33 of the actuators 14, eject the ink from the ejection nozzles 28, and form images on the sheet P held on the conveyance belt 118.

Also, as part of the liquid ejection operation, the control unit 116 drives the circulation pumps 134 to circulate the liquid or the ink in the circulation flow paths via the ink tanks 132 and the inkjet heads 10. By this circulation operation, the circulation pump 134 is driven to supply the ink in the ink tanks 132 from the supply holes 25 to the supply chambers 161 of the ink chamber 16 via the ink supply unit 181 of the manifold 18. Ink is supplied to both the drive flow paths 31 and the dummy flow paths 32. The ink flows into the discharge chambers 162 of the ink chamber 16 via the drive flow paths 31 and the dummy flow paths 32. The ink is discharged from the discharge holes 26 to the ink tanks 132 via the ink discharge units 182 of the manifolds 18.

[Modifications]

The disclosure is not limited to the above-described first and second embodiments. Components, elements, configurations, and the like can be modified by those of ordinary skill in the art without departing from the scope of the present disclosure.

For example, while in the first embodiment, each of the dummy nozzles 29 has the same shape as the ejection nozzles 28, embodiments are not limited thereto. For example, the total number of dummy nozzles 29 may be reduced by increasing the opening area of the dummy nozzles 29 relative to the ejection nozzles 28, or conversely, a more dummy nozzles 29 may be incorporated by decreasing the opening area of the dummy nozzles 29 relative to the ejection nozzles 28.

Figure 8:
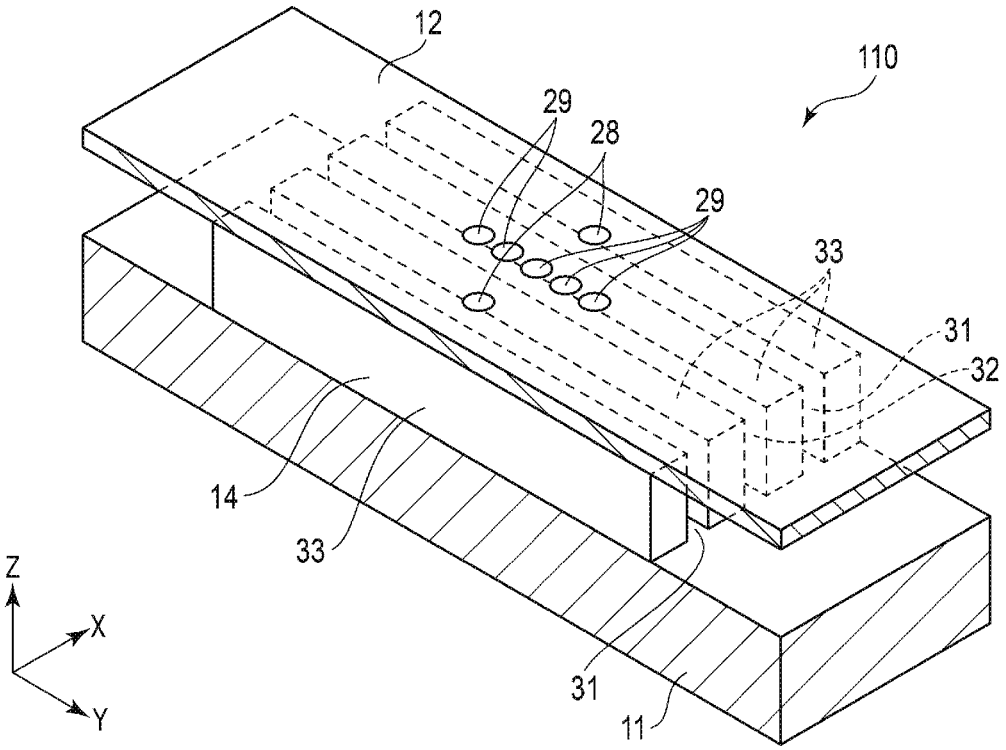
FIG. 8 depicts aspects of a liquid ejection head according to another embodiment.
Figure 9:
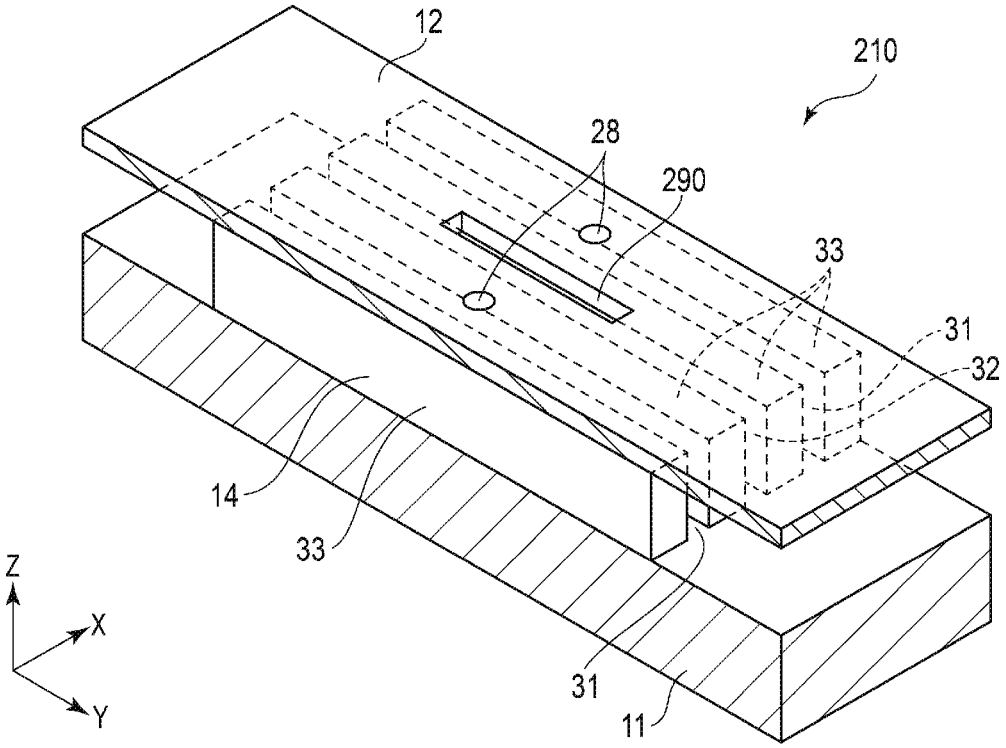
FIG. 9 depicts aspects of a liquid ejection head according to a modified embodiment.

While in the first embodiment, as illustrated in FIG. 2, each widthwise (Y direction) subgroup or subset of the dummy nozzles 29 in each of the two lengthwise (X direction) rows extends along the entire or substantially entire length of the corresponding one of the dummy flow paths 32 in the second direction/Y direction (that is the lengthwise direction of the dummy flow path 32), embodiments are not limited thereto. In one modified embodiment, as illustrated in FIG. 8, an inkjet head 110 may have a subgroup of dummy nozzles 29 formed only in a central portion along the length of a dummy flow path 32 rather than substantially the end-to-end length of the dummy flow path 32. The subgroup may be centered between the adjacent ejection nozzles 28. Alternatively, in another embodiment, as illustrated in FIG. 9, an inkjet head 210 comprises a dummy nozzle 290 having a slit or slot shape extending along the second direction/Y direction rather than round (cylindrical).

In the above examples, a liquid ejection head is incorporated into an inkjet printer, such as the inkjet recording device 100, for forming a two-dimensional image with the ink on a sheet P or the like, but the present disclosure is not limited thereto. In other examples, the described liquid ejection heads can be incorporated in, or utilized as, an inkjet recording device 100 such as a 3D printer, an industrial manufacturing machine, or a medical machine dispensing liquids. In the case of the 3D printer, a three-dimensional object can be formed by ejecting a substance such as a binder for solidifying a material or the like from the inkjet head.

The number of inkjet heads 10 or colors and characteristics of the ink or liquid to be used for image forming can be varied as appropriate. Transparent glossy ink, ink that develops colors upon being irradiated with infrared or ultraviolet rays, or other specialty inks can be ejected.

As still another embodiment, the inkjet head 10 may be used for ejecting a liquid other than ink. For example, a dispersion liquid, such as a suspension or solution, may be ejected. Examples of a liquid other than the ink that can be ejected by the inkjet head 10 include, but are not limited to, a liquid such as a resist type material for forming a wiring pattern on a printed wiring board, a liquid including cells therein for artificially forming a tissue or an organ, binders such as an adhesive, wax, or a liquid resin.

With a liquid ejection head, such as the inkjet head 10, and a liquid ejection device, such as the inkjet recording device 100, according to at least one of the present embodiments, crosstalk between adjacent nozzles can be effectively suppressed.

While certain embodiments have been described, these embodiments have been presented by way of example only and are not intended to limit the scope of the disclosure. Indeed, the novel embodiments described herein may be embodied in a variety of other forms; furthermore, various omissions, substitutions and changes in the form of the embodiments described herein may be made without departing from the spirit of the disclosure. The accompanying claims and their equivalents are intended to cover such forms or modifications as would fall within the scope and spirit of the disclosure.

What is claimed is:

1. A liquid ejection head, comprising:
a plurality of drive flow paths each connected to an ejection nozzle;
a plurality of dummy flow paths each connected to a dummy nozzle, the dummy flow paths each being adjacent to at least one of the drive flow paths; and
a plurality of side walls, each being between one of the drive flow paths and one of the dummy flow paths and configured to simultaneously change volumes of the one of the drive flow paths and one of the dummy flow paths in response to drive signals, wherein
a first acoustic resonance period of liquid in each of the dummy flow paths is shorter than a second acoustic resonance period of the liquid in each of the drive flow paths.

2. The liquid ejection head according to claim 1, wherein
the ejection nozzles eject the liquid in response to drive signals, and
the dummy nozzles do not eject the liquid in response to the drive signals.

3. The liquid ejection head according to claim 1, wherein the first acoustic resonance is less than or equal to ½ of the second acoustic resonance period.

4. The liquid ejection head according to claim 1, further comprising:
a base in which the plurality of drive flow paths and the plurality dummy flow paths are formed; and
a nozzle plate facing the base and having the liquid ejection nozzles and the dummy nozzles formed therein.

5. The liquid ejection head according to claim 1, wherein the plurality of dummy nozzles is grouped in sub-groups corresponding to each of the dummy flow paths in the plurality of dummy flow paths.

6. The liquid ejection head according to claim 5, wherein each sub-group spans substantially the full length of the corresponding dummy flow path.

7. The liquid ejection head according to claim 5, wherein each sub-group is positioned only in a middle portion of the corresponding dummy flow path and not at either end portion of the corresponding dummy flow path.

8. The liquid ejection head according to claim 1, wherein the dummy nozzles are shaped as slots extending longitudinally in the same direction as the corresponding dummy flow paths.

9. The liquid ejection head according to claim 1, wherein both ends of each dummy flow path are connected to a common liquid chamber.

10. The liquid ejection head according to claim 1, wherein the at least one of the dummy nozzles has a slot shape.

11. The liquid ejection head according to claim 1, wherein a half cycle (AL) of the first acoustic resonance period is equal to $2\pi/\{c\sqrt{(Sn/Vd/Ln)}\}$, where
the value c is a pressure propagation velocity of the liquid in the dummy flow paths,
the value Sn is an opening area of each dummy nozzle,
the value Ln is a length of the ejection nozzle or the dummy nozzle, and
the value Vd is a volume of the dummy flow path per each dummy nozzle on the dummy flow path.

12. The liquid ejection head according to claim 1, wherein the plurality of side walls selectively deformable by application of voltages to electrodes are electrically connected to each of the sidewalls.

13. The liquid ejection head according to claim 1, wherein the liquid is an ink.

14. A liquid ejection head, comprising:
a plurality of drive flow paths connected to liquid ejection nozzles;
a plurality of dummy flow paths connected to dummy nozzles, the dummy flow paths being adjacent to the drive flow paths; and
a plurality of side walls, each sidewall being shared between one of the drive flow paths and one of the dummy flow paths and configured to deform in response to a drive signal, wherein
a first acoustic resonance period of liquid in each of the dummy flow paths is less than or equal to ½ of a second acoustic resonance period of the liquid in each of the drive flow paths.

15. The liquid ejection head according to claim 14, wherein
each dummy flow path has more than one dummy nozzle thereon, and
each drive flow path has just one ejection nozzle thereon.

16. The liquid ejection head according to claim 14, wherein
each dummy flow path has just one dummy nozzle thereon,
each drive flow path has just one ejection nozzle thereon, and
each dummy nozzle is slot shaped.

17. A printer device, comprising:
a tank configured to hold a liquid; and
a liquid ejection head fluidly connected to the tank and comprising:
a plurality of drive flow paths each respectively connected to a liquid ejection nozzle;
a plurality of dummy flow paths each respectively connected to at least one dummy nozzle, each dummy flow path being adjacent to at least one drive flow path; and
a plurality of side walls, each side wall being between one of the drive flow paths and one of the dummy flow paths and configured to change volumes of the drive flow path and the dummy flow path in response to drive signals, wherein
a first acoustic resonance period of the liquid in each dummy flow path is less than a second acoustic resonance period of the liquid in each drive flow path.

18. The printer device according to claim 17, wherein the first acoustic resonance is less than or equal to ½ of the second acoustic resonance period.

19. The printer device according to claim 17, wherein
each dummy flow path has more than one dummy nozzle thereon, and
each drive flow path has just one ejection nozzle thereon.

20. The printer device according to claim 17, wherein each dummy flow path has just one dummy nozzle thereon nozzle each drive flow path has just one ejection nozzle thereon, and each dummy nozzle is slot shaped.

* * * * *